United States Patent [19]

Fletcher et al.

[11] Patent Number: 4,869,230

[45] Date of Patent: Sep. 26, 1989

[54] SPACE HEATING APPLIANCE

[75] Inventors: John E. Fletcher, Worcester; William Yale, Tipton, both of England

[73] Assignee: Ambi-Rad Limited, England

[21] Appl. No.: 231,846

[22] Filed: Aug. 12, 1988

[51] Int. Cl.[4] ..... F24C 3/00

[52] U.S. Cl. ..... 126/91 A; 431/114; 431/328; 138/38

[58] Field of Search ..... 431/19, 170, 326, 346, 431/328, 114; 126/91 R, 91 A; 138/38; 165/174

[56] References Cited

U.S. PATENT DOCUMENTS

| | | | |
|---|---|---|---|
| 1,246,583 | 11/1917 | Fulweiler | 138/38 |
| 1,372,724 | 3/1921 | Stine | 431/328 |
| 1,896,286 | 2/1933 | Burns et al. | 431/328 |
| 4,457,692 | 7/1984 | Erdman | 431/19 |
| 4,529,123 | 7/1985 | Johnson | 237/1 R |
| 4,731,015 | 3/1988 | Johnson | 126/91 A |

FOREIGN PATENT DOCUMENTS

| | | |
|---|---|---|
| 2804473 | 8/1978 | Fed. Rep. of Germany . |
| 2560359 | 8/1985 | France . |
| 661431 | 11/1951 | United Kingdom . |

*Primary Examiner*—Noah P. Kamen

*Attorney, Agent, or Firm*—Learman & McCulloch

[57] ABSTRACT

Radiant tube space heating appliance includes a burner assembly (12), air flow therethrough being induced by a fan (14) by way of a restricted air inlet orifice (34) communicating with a stabilizing chamber (32) leading to the burner head (26) for smoothing and silencing the air flow; the burner head including a flame stabilizing matrix (40), conveniently formed from windings of flat and corrugated stainless strips (42,43) which define through apertures of substantial axial length. The appliance may further include a turbulator insert (50) in the radiant tube formed as a corrugated strip (52) of stainless steel or similar material which is twisted to form a helix.

12 Claims, 6 Drawing Sheets

SPACE HEATING APPLIANCE

This invention relates generally to space heating appliances of the kind known as radiant tube heaters comprising a U-shaped or other tube operatively carrying a flow of hot gases from a burner at an upstream end of the tube, typically gas fuelled, said flow being induced by a fan or other flow inducing means, typically located at the downstream end of the tube, the space heating effect being largely provided by radiation from the tube walls which may be directed by means of a reflector adjacent to the tube, e.g. downwardly, where the appliance is suspended in an upper region of the room or other space being heated. Said appliances are hereinafter described as "radiant tube heaters of the kind described".

Aspects of the invention further relate to inserts for modifying fluid flow in said radiant tube heaters and particularly but not exclusively to turbulators or other inserts for improving heat transfer between fluid flow within the tube and the tube walls.

BACKGROUND OF THE INVENTION

Various types of turbulator inserts are known for improving heat transfer and other flow modifying purposes, for example wound and twisted wire inserts, or metal strip inserts shaped and deformed to complex bent and twisted shapes to cause changes in direction of the fluid flow within the tube. This type of turbulator acts largely by sideways buffeting of the fluid flow which causes high pressure resistance and increases the energy needed to maintain the through flow. Moreover they are effective only within the localised length of the duct in which they are installed and have little or no effect downstream thereof.

Another form of known turbulator or flow modifying insert consists of a flat strip of metal equal in width to the tube internal diameter and twisted to form a helix so that the through flow follows a spiral path improving contact with the tube wall and also providing an enhanced effect downstream of the insert in that the gases exiting therefrom will continue to spin giving some additional scrubbing effect and wall contact after their exit from the spiral. This type of insert gives relatively low pressure resistance, however the spirally shaped strip is difficult and expensive to manufacture, particularly where costly high grade heat resisting metals are needed for high temperature and/or corrosive or other aggressive gases or other fluids.

SUMMARY OF THE INVENTION

The object of the invention is to provide a radiant tube heater of the kind described which is particularly quiet in operation yet which is economic and efficient to provide and run, and reliable and safe in use. A further object is to provide for the simple, economical and durable construction of said heaters.

According to a first aspect of the invention a radiant tube heater of the kind described is characterised in that air infeed means of the burner is formed to smooth and silence turbulence in the air flow caused by a restricted air inlet orifice and to direct said flow evenly along a head of the burner in a direction axially of the latter, and in that the burner head includes a flame stabilising matrix at its mouth defining a plurality of through passages of substantial length for stabilising combustion at the downstream end of the burner head while resisting burning back into the head interior.

Preferably said air feed means includes structure defining a stabilising chamber immediately downstream of the inlet orifice in which the air flow is operatively smoothed and slowed to a lower velocity, and is formed to direct said flow along the burner head in a smooth path without undue restriction or abrupt changes of direction.

According to a second aspect of the invention a radiant tube heater of the kind described is characterised by including a matrix or insert for modifying or otherwise directing or controlling fluid flow of gases in the heater in use formed at least in part of a longitudinal strip of sheet material having transverse corrugations and wound or twisted to form a coil or helix locating in a tubular casing or duct.

Preferably the burner head matrix comprises windings of alternate layers of said corrugated and flat metal strip material (e.g. stainless steel) so defining a plurality of through passages axially of the head.

It is also preferred that the radiant tube includes a helical tubulator insert formed from said corrugated strip to improve heat transfer to the tube walls.

THE DRAWINGS

An example of the invention is more particularly described with reference to the accompanying drawings wherein.

THE PREFERRED EMBODIMENT

Figure 8:
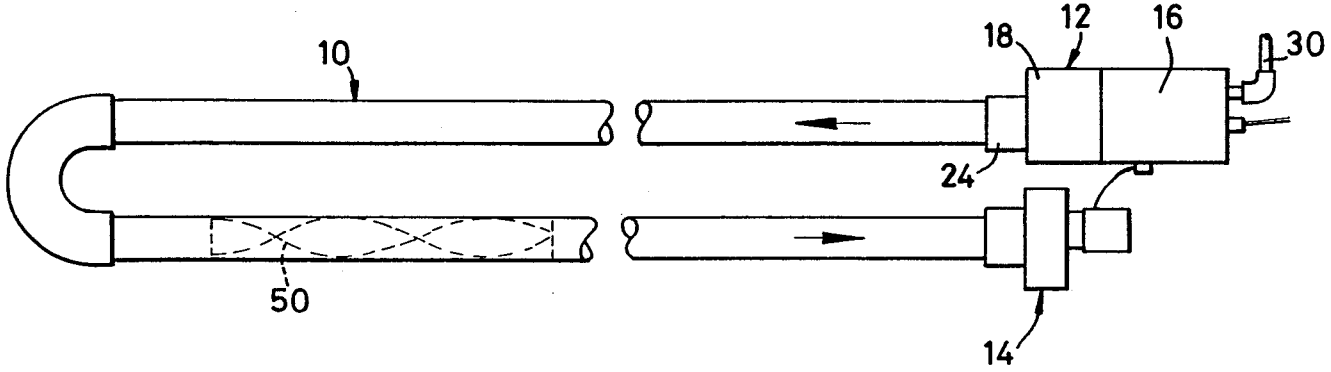
FIG. 8 is a diagrammatic plan view of a radiant tube heater incorporating the burner assembly.

The radiant tube heater of the kind described of which the invention forms part in this example comprises a U-shaped radiant tube 10 (FIG. 8) having a burner assembly 12 at the upstream end and a flow inducing extraction fan 14 at the downstream end.

Figure 1:
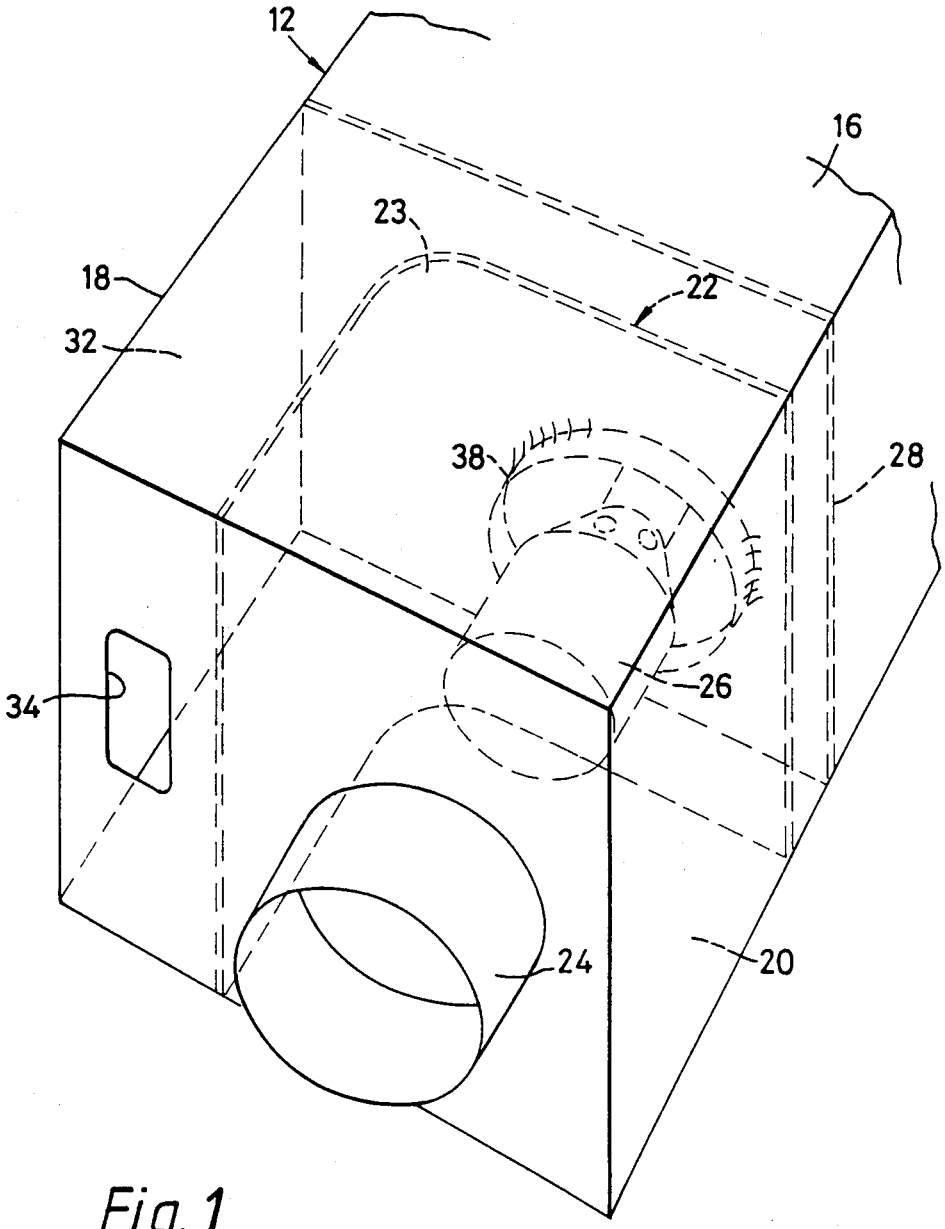
FIG. 1 is a diagrammatic perspective view of a burner assembly.
Figure 2:
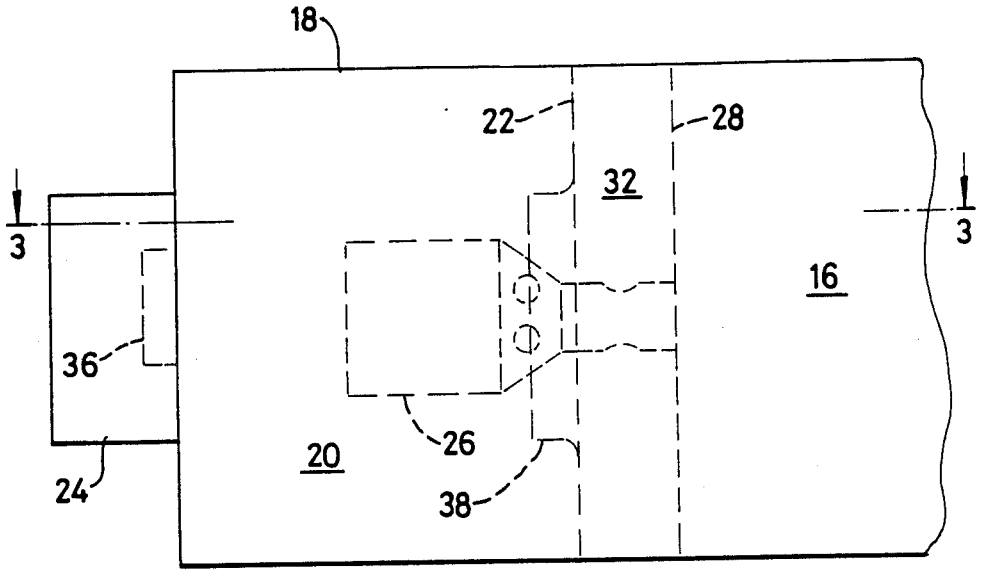
FIG. 2 is a side elevation thereof.
Figure 3:
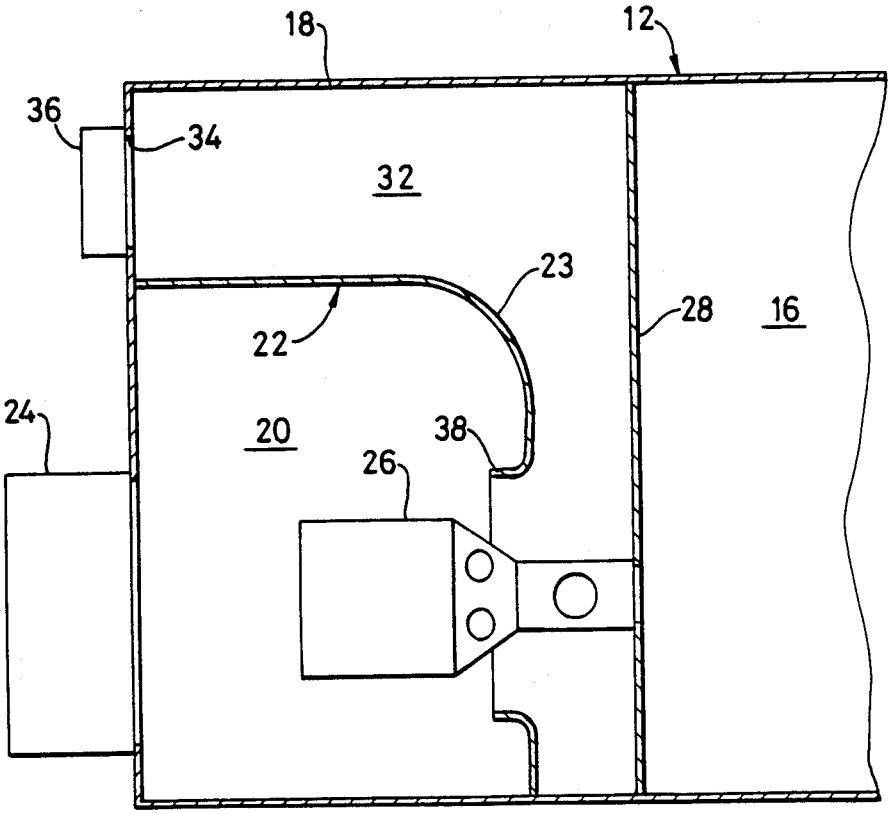
FIG. 3 is a horizontal section on line 3—3 of FIG. 2.
Figure 7:
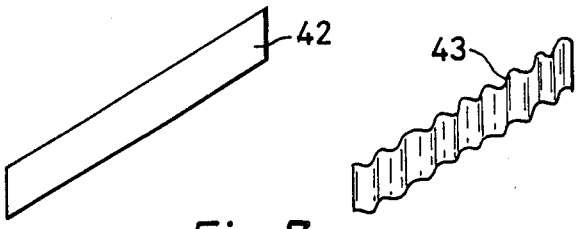
FIG. 7 is a perspective view of strip material used to form a matrix of said head.
Figure 4:
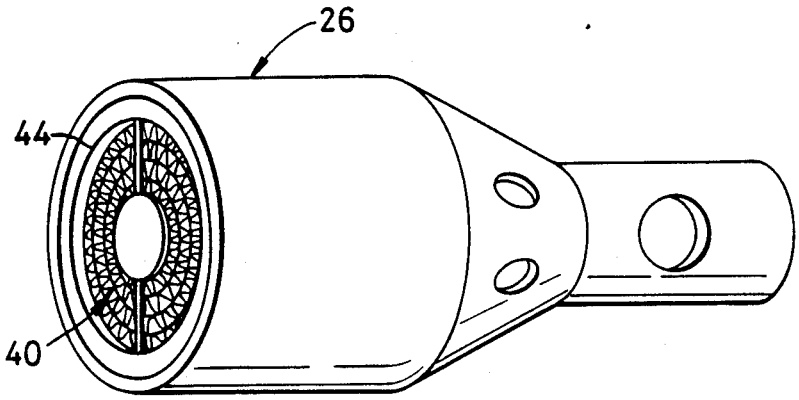
FIG. 4 is a perspective view of a burner head of the assembly.
Figure 5:
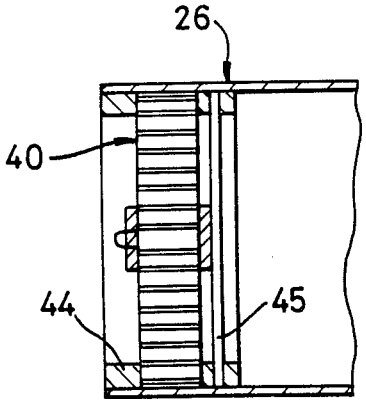
FIG. 5 is a vertical section of an outer end of said head.
Figure 6:
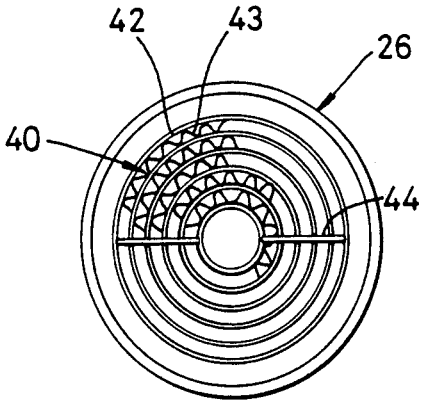
FIG. 6 is an end view thereof.

Assembly 12 includes a control section 16 of generally conventional type incorporating automatic ignition, operation and safety controls and a combustion chamber section 18 which is now further described in detail with reference to FIGS. 1–3.

Section 18 is a box-like structure defining a combustion chamber 20 defined in part by an L-shaped interior wall 22 having a smoothly radiused corner 23.

An outlet 24 in the front wall of chamber 20 forms a connection with the upstream end of tube 10 and spaced in axial alignment to the rear of this is a burner head 26 described in greater detail below which projects into chamber 23 from the division wall 28 between said sections 16 and 18. The head is operatively supplied with gas fuel from a gas feed pipe 30 through regulating and control valves (not shown) in section 16.

Air infeed means of the assembly comprises an L-shaped stabilizing chamber 32 defined between internal wall 22, rear wall 28 and a side wall of section 18, air being drawn into said chamber by the action of fan 14 in operation by way of a restricted air inlet orifice 34 in the front wall of section 18. A baffle 36 (not shown in FIG. 1) protects the exterior of orifice 34.

The restriction of air flow due to the dimensions of orifice 34 ensures that there is a degree of depression within the burner assembly when fan 14 is operating with normal unobstructed flow through tube 10 and a vacuum sensor (not shown) operates in known manner to prevent or shut off operation of the burner if such depression is not maintained, eg due to a blockage or a fault in fan 14. However, with many known burner assemblies of this type the operation is unduly noisy due to the turbulence induced by the restricted orifice and due to constrictions and irregularities in the air path from the orifice to the combustion chamber. Excessive noise is a nuisance and unpleasant and has, in the past, precluded the use of this type of heater in such buildings as halls for public meetings and social functions, churches and other places of worship and the like.

The shaping of stabilizing chamber 32 allows for smoothing and slowing to a lower velocity of the air flow passing through orifice 34, it is then swept around the radiused corner 23 of wall 22 without any unduly abrupt change of direction and passes into combustion chamber 20 by way of a large diameter cylindrical sleeve 38 in surrounding relationship and co-axial with burner head 26, the inner end of sleeve 38 merging with wall 22 at a radiused corner. Thus there is a smooth transition for the air flow into chamber 20 and it is directed along burner head 26 axially of the latter in an even flow along and in the head so that there is gentle laminar mixing with the gas fuel, and noise at the mixing and combustion areas is again substantially reduced.

The efficient and quiet operation of burner head 26 itself is further assured by its manner of construction now described in greater detail with reference to FIGS. 4–7. A tubular casing constituting the outlet end of head 26 is occupied by a matrix 40 built up from stainless steel strip metal, in this example 10 mm wide using flat and corrugated strips 42, 43 (FIG. 7) wound in alternate layers to form a honeycomb like disc having a large number of through apertures of substantial axial length (in this case 10 mm).

The matrix is located in head 26 by means of a pair of press fitted spiders 44, 45 at front and back each comprising an outer ring which is a press fit within the cylindrical sleeve of head 26, a diametral cross-bar and a central boss abutting the centre of matrix 40 for its axial location.

Matrix 40 smoothes the outflow of gas/air mix from head 26 and stabilizes combustion at the outer end of the head and therebeyond into the combustion chamber again giving substantial noise reduction and efficient and safe operation. Any tendency for the flame to "burn back" into the head is resisted by the cooling or quenching effect of the matrix yet its through passages can be of substantial size in comparison with mesh or gauze used in some applications to prevent burning back, thus there is less likelihood of blockage and improper functioning. The matrix is also stronger and more durable than mesh or gauze, can readily be removed for cleaning or replaced if necessary, and is simple and economical to manufacture.

For maximum heating effect it is important that there is good heat transfer from the gas flow to the walls of the U-shaped tube 10 for radiation from the latter.

Figure 9:
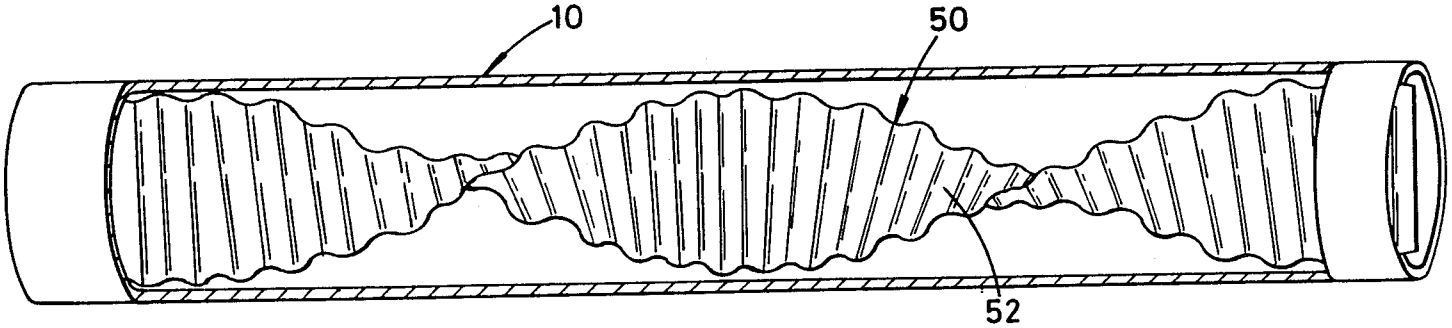
FIG. 9 is a part sectional view of part of a radiant tube of the heater.

To enhance such transfer, particularly in the downstream limb of the tube, it is preferred that a spiral turbulator or insert 50 is positioned in a portion of tube 10 as best seen in FIG. 9.

Insert 50 is formed from a strip of sheet metal 52, for example stainless steel of 0.3 mm gauge, the strip having a width slightly less than the internal diameter of tube 10, for example 70 mm width for use in 75 mm internal diameter tube.

The strip is subjected to a crimping process by passing it through a pair of meshing toothed rollers to form transverse corrugations along its full length. This is a very simple process which merely involves bending the light gauge metal without any actual stretching or other deformation and the axial length of the rollers used can be sufficient to accommodate a wide range of strip widths for making inserts for tubes of varying diameters. The pitch of the corrugations may, for example, be 12 mm and their trough to crest height 4 mm for 70 mm width strip.

Figure 10:
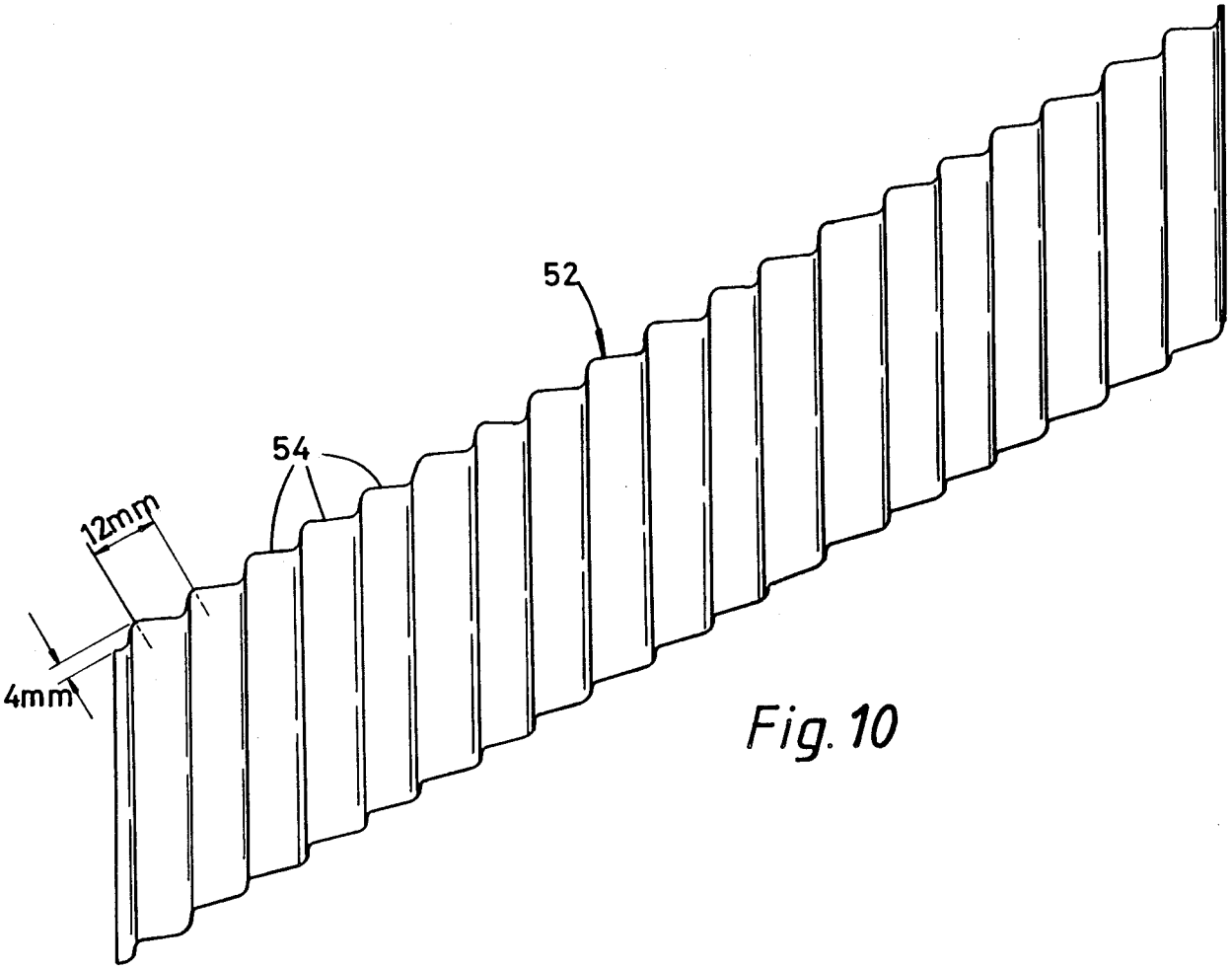
FIG. 10 is a perspective view of an insert for said tube at one stage of its manufacture.

This stage of manufacture is shown in FIG. 10 and the strip so formed can readily be stored or transported as a coil until required for use.

Corrugations 54 enable strip 52 to be readily twisted about a longitudinal axis to form a helix, and the pitch of the turns thereof can very readily be varied according to requirements. This process can readily be carried out by hand or using simple tools either before or at the time of the insertion of the strip into tube 10, indeed if an insert has to be positioned in the tube in a confined space, for example positioning a long insert in a tube where there is restricted clearance at the tube mouth, the flexibility of the strip prior to or during twisting will be found to be particularly convenient. There is also the possibility of feeding the strip around a bend in the tube while forming the twist.

In forming a helix in a flat metal strip the outer borders of the strip have to be stretched relative to the centre area which necessitates special tools and processes and also means that heavier gauge material must be used which can be stretched without tearing. On the other hand, the corrugations 54 of strip 52 permit its outer borders to expand longitudinally relative to its central area without difficulty and the rigidity provided by the lateral corrugations also facilitate easy and even twisting. Typically the strip 52 is twisted to a pitch of from 250 to 350 mm using 70 mm wide strip.

Corrugations 54 themselves provide a slight increase in gas turbulence in the region of tube 10 occupied by insert 50 as well as the improved heat transfer provided by the scrubbing effect of the spiral gas flow on the wall of tube 10 due to the helical shaping of insert 50. The twisting impetus imparted to the gases as they exit from the downstream end of the insert 50 continues this scrubbing effect giving increased heat transfer in regions of tube 10 downstream of the insert again giving increased efficiency of operation.

As in the case of the strips 42 and 43 used to form matrix 40 of burner head 26 of the use of light gauge strip material gives considerable economy of material (e.g. of costly corrosion and heat resistant stainless steel) and a possible reduction in weight as well as the economies of manufacture and assembly referred to above.

We claim:

1. A heater assembly comprising a radiant tube for carrying a stream of hot gases to provide space heating by radiation from the tube; gas flow inducing means at a downstream part of said tube for inducing the flow of said stream of gases along said tube; burner means within a combustion chamber having spaced walls, said combustion chamber having an outlet in one of said walls and an inlet in another of said walls, said inlet being in communication with said tube upstream from said flow inducing means; air feed means upstream from said burner means for providing combustion air to said inlet of said combustion chamber, said air feed means comprising a stabilization chamber having a restricted inlet orifice, said stabilization chamber having a capacity sufficient to smooth and slow to a lower velocity air admitted to said stabilization chamber via said inlet orifice thereby silencing turbulence resulting from the passage of air through said inlet orifice; and inlet sleeve means in communication with said stabilization chamber remote from said inlet orifice and extending into said combustion chamber in coaxial relationship with said burner means for directing said combustion air evenly along and in encircling relationship to said burner means in a direction axially thereof in a smooth path with little restriction or abrupt changes of direction, said burner means inducing a flame stabilising matrix at its mouth defining a plurality of through passages of substantial length for stabilising combustion at the downstream end of the burner means while resisting burning back into the burner means.

2. An assembly according to claim 1 including a flow modifying insert within said tube, said insert comprising a strip of sheet material twisted about a longitudinal axis to form a helix.

3. An assembly according to claim 2 wherein said strip is traversely corrugated.

4. An assembly according to claim 3 wherein the corrugations are formed by passing the strip through a pair of meshing toothed rollers to crim it.

5. An assembly according to claim 2 wherein said material is 0.3 mm gauge stainless steel.

6. A assembly according to claim 2 characterised in that the twisting is effected before the strip is inserted into the tube.

7. A assembly according to claim 2 characterised in that the twisting is effected while the strip is being fed into the tube.

8. An assembly as in claim 1 characterised in that the flame stabilising matrix comprises windings of strip material arranged to define said plurality of through passages.

9. An assembly as in claim 8 characterised in that said windings are of alternate layers of corrugated strip material and flat strip material.

10. An assembly as in claim 8 characterised in that said strip material is stainless steel.

11. An assembly according to claim 1 wherein said sleeve means has an outer end located within said combustion chamber and an inner end which smoothly merges with said another wall of said combustion chamber.

12. An assembly according to claim 1 wherein said stabilising chamber is L-shaped and has a smoothly curved wall along one side of said stabilization chamber, said inlet orifice and said sleeve means being spaced from and substantially parallel to one another.

* * * * *